US006363672B1

(12) United States Patent
Baker

(10) Patent No.: US 6,363,672 B1
(45) Date of Patent: Apr. 2, 2002

(54) LOG HOME CONSTRUCTION, AND METHODS

(76) Inventor: Daniel A. Baker, P.O. Box 1211, Swan Valley, MT (US) 59826

( * ) Notice: Subject to any disclaimer, the term of this patent is extended or adjusted under 35 U.S.C. 154(b) by 0 days.

(21) Appl. No.: 09/559,510

(22) Filed: Apr. 27, 2000

Related U.S. Application Data

(60) Provisional application No. 60/182,238, filed on Feb. 14, 2000.

(51) Int. Cl.[7] ..... E04B 1/10

(52) U.S. Cl. ..... 52/233; 52/747; 52/313; 52/90; 52/586.1

(58) Field of Search ..... 52/233, 747, 313, 52/90, 586.1

(56) References Cited

U.S. PATENT DOCUMENTS

| | | | | | |
|---|---|---|---|---|---|
| 1,813,455 | A | * | 7/1931 | Lawton | 52/233 |
| 2,403,934 | A | * | 7/1946 | Lindstrom | 20/4 |
| 2,525,659 | A | * | 10/1950 | Edson et al. | 52/233 |
| 4,034,527 | A | | 7/1977 | Jalasjaa | |
| 4,056,906 | A | | 11/1977 | Elfstrom | |
| 4,126,977 | A | | 11/1978 | Chisum | |
| 4,219,977 | A | | 9/1980 | Bene et al. | |
| 4,391,067 | A | | 7/1983 | Frady et al. | |
| 4,463,532 | A | | 8/1984 | Faw | |
| 4,527,981 | A | | 7/1985 | Chisum | |
| 4,640,069 | A | * | 2/1987 | Felser | 52/233 |
| 4,742,657 | A | * | 5/1988 | Veech | 52/233 |
| 4,840,003 | A | | 6/1989 | Lucas et al. | |
| 4,951,435 | A | | 8/1990 | Beckedorf | |
| 4,967,526 | A | | 11/1990 | Yost | |
| 5,058,343 | A | * | 10/1991 | Nipko | 52/233 |
| D334,808 | S | | 4/1993 | McBride et al. | |
| 5,265,390 | A | * | 11/1993 | Tanner | 52/233 |
| 5,718,091 | A | | 2/1998 | Sellers et al. | |
| 5,799,452 | A | | 9/1998 | Moore | |
| 6,199,332 | B1 | * | 3/2001 | Ellson | 52/233 |

* cited by examiner

*Primary Examiner*—Carl D. Friedman
*Assistant Examiner*—Chi Q. Nguyen
(74) *Attorney, Agent, or Firm*—Merchant & Gould P.C.

(57) ABSTRACT

A log construction, such as a log home or log cabin. The construction includes a plurality of horizontal logs extending between vertical log posts. A cap log can extending across a length of at least three vertical log posts. The load of the structure, particularly the roof, is supported by the vertical log posts. The ends of the horizontal logs abut and are preferably secured to the vertical posts. In one embodiment, old or dead logs, rather than green logs, are used in the construction.

22 Claims, 2 Drawing Sheets

FIG.3
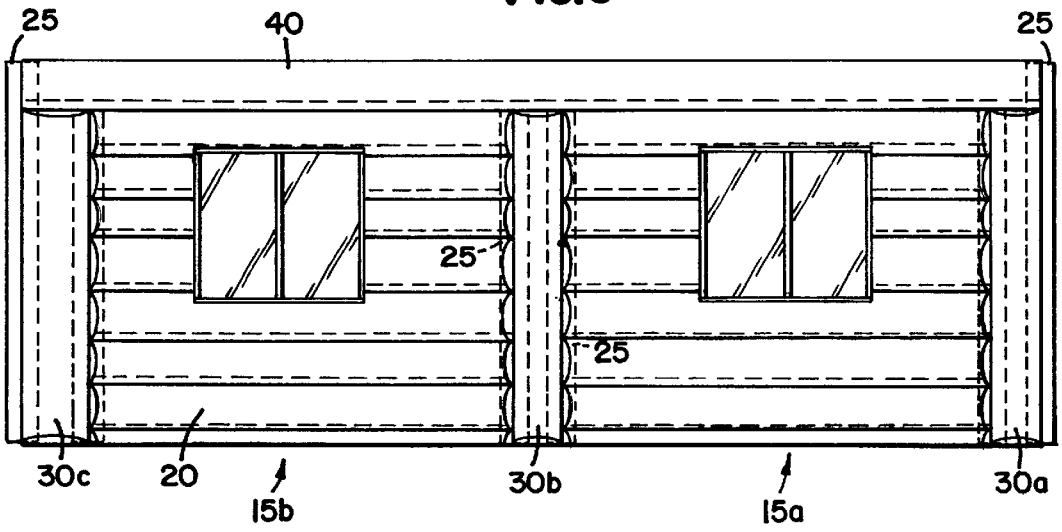
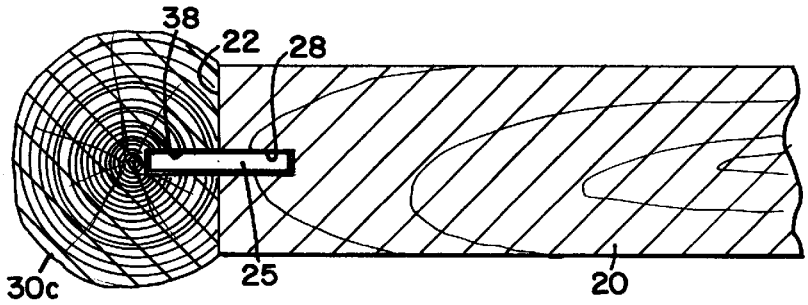
FIG.4
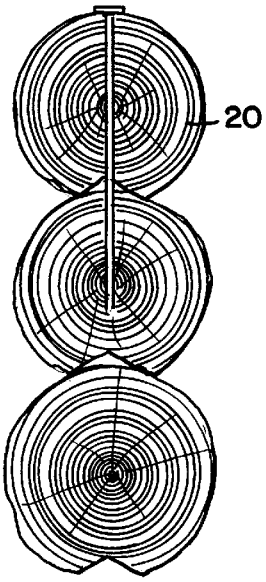
FIG. 5

LOG HOME CONSTRUCTION, AND METHODS

This appln. claims benefit of Prov. No. 60/182,238 Feb. 14, 2000.

The field of the invention relates to construction of a house, cabin, or other structure from logs.

BACKGROUND OF THE INVENTION

Log cabins have been known and used as dwellings for hundreds of years. The current methods of building a log cabin include construction of a cabin by hand from logs in their natural shape, and construction of a cabin from interchangeable prefabricated logs produced in a manufacturing environment. In either method, logs are stacked horizontally crosswise to form a multi-walled structure. The number of logs stacked generally dictates the height of the structure.

The common techniques for log home construction have many non-desirable aspects, concerns, and maintenance problems associated with the house.

One common problem is vertical shrinkage or settling of the house. As the logs dry, they have a tendency to slightly shrink and settle. One common result of settling logs is the decrease in overall vertical height of the wall. As the logs settle, even slightly, the overall height of the house decreases; this leads to various problems throughout the house.

The overall problem caused by shrinkage of the house is that the finished work inside the house cracks, warps, gets crushed, and otherwise is deformed and distorted. For example, drywall and plaster walls crack, and more durable yet expensive wall surfaces, such as wainscot tiling, can break. Compression of the walls also hinders swinging of doors, both interior and exterior. Stairways can misalign with the upper floor. Depending on the amount of wall shrinkage, pipes within the wall may bend or break, and chimneys may crumble.

Another common facet of conventional log building techniques is that the length or width of the home is dependent on the length of the logs. Having long logs has at least two major disadvantages. First, the price for logs exponentially increases in relation to the length needed, drastically driving up the cost of larger houses. Second, portions of many of these long logs are wasted, because most exterior walls are constructed as solid walls, with the logs extending the entire length of the wall. First, the log is cut to the desired length, creating wasted material. Openings for any doors or windows are cut out from the solid wall and the material removed from the openings is discarded. The home owner is paying for log material not utilized in the final house.

These concerns, those of maintenance problems and high expenses, are drawbacks to a log building. The log home construction of the present invention minimizes, and generally eliminates, these concerns and problems.

SUMMARY OF THE INVENTION

This invention is directed to log homes, cabins, and other structures. The log construction of the present invention provides a log building that has minimal settling, which decreases the maintenance needed on the building.

Further, the log construction of the present invention minimizes the amount of logs needed to construct the building, as compared to conventional log constructions. This reduces the cost of the construction, which can be passed on to the owner.

In particular, the present invention is directed to a log construction, such as a log home, having at least one exterior wall that has a first plurality of horizontal logs extending from a first vertical post to a second vertical post, and a second plurality of horizontal logs extending from the second vertical post to a third vertical post. In one embodiment, the horizontal logs each has a first end face and an opposed second end face; each of these faces having a groove therein. The first and second vertical posts also have grooves therein. A spline is positioned in each of the grooves, so as to connect the horizontal logs to the vertical posts. A cap log extends the length of the construction wall and functions as a header beam.

In another aspect, the invention is directed to a log construction having an exterior wall. The exterior wall includes a plurality of vertical posts, where one of the plurality of vertical posts positioned in each corner of the log construction. A second plurality of vertical posts is positioned within the exterior wall, generally at least one between each corner post. Multiple horizontal logs extend between adjacent vertical posts.

Methods of making a log construction, such as residential homes, barns, and the like, are also disclosed.

BRIEF DESCRIPTION OF THE DRAWINGS

FIG. 3 is a front view of one wall of the log home of FIG. 1, which includes two sections;

FIG. 4 is a top view of a portion of the log home section of FIG. 3; and FIG. 5 is a partial cross sectional view taken along line 5—5 of the log home section of FIG. 3.

DETAILED DESCRIPTION OF THE PREFERRED EMBODIMENT

Attention is now directed to the figures, where various aspects and the preferred embodiments of the invention are illustrated.

Figure 1:
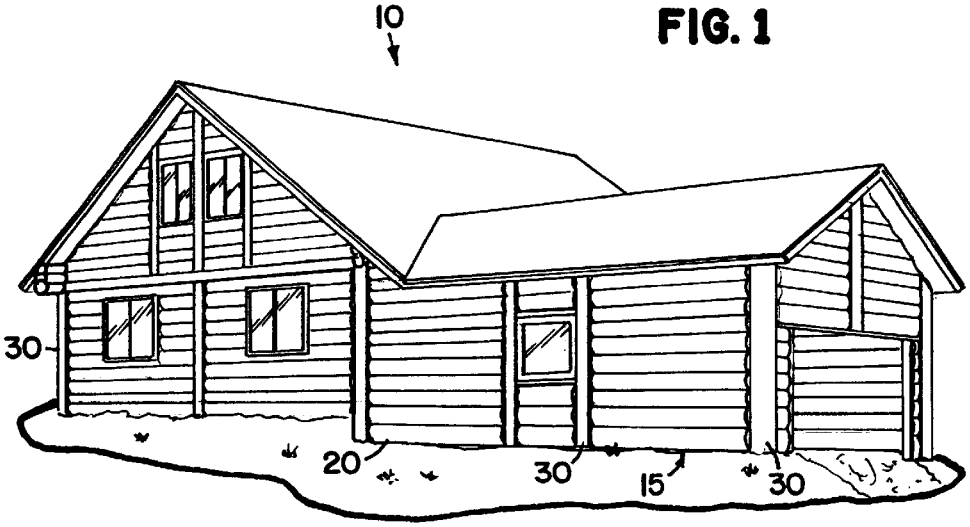
FIG. 1 is a perspective view of a log home constructed according to the present invention.
Figure 2:
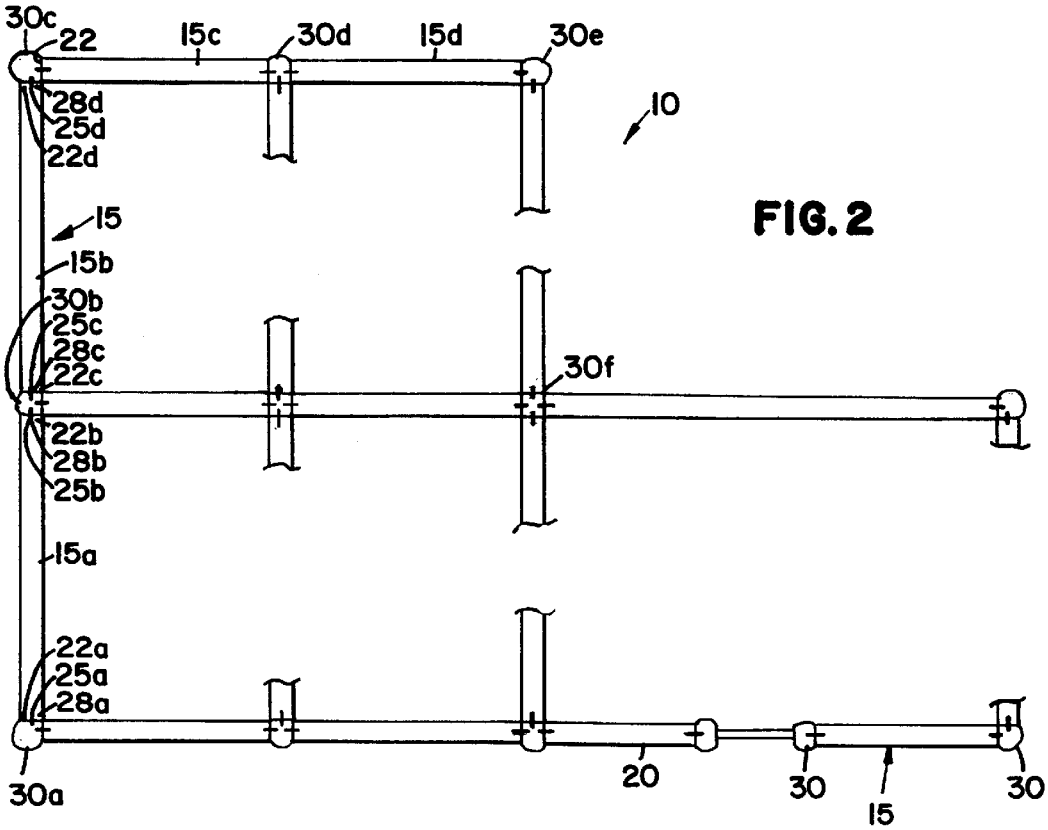
FIG. 2 is a top view of the log home of FIG. 1, shown without the roof.

FIGS. 1 and 2 show a log building constructed in accordance with the present invention. Specifically, FIG. 1 shows a log home 10 constructed of multiple horizontal logs 20 filling in the walls between vertical posts 30.

As seen best in FIG. 2, log home 10 is constructed of multiple sections 15; multiple sections 15 specifically are numbered as sections 15*a,* 15*b,* etc. in FIG. 2. Each section 15 is defined by a plurality of horizontal logs 20 positioned between vertical posts 30. Generally, multiple sections 15 are used to form a wall of log home 10; that is, a single section 15 does not typically extend the entire length or width of log home 10.

Generally, both horizontal logs 20 and vertical posts 30 have essentially circular cross-sectional areas; that is, the logs and posts have a circular circumference. In some embodiments, it may be desired to use logs or posts that have been shaped. For example, either logs 20 or posts 30 can be square, diamond shaped, oval, and the like, or have a surface texture imparted therein, such as flutes, cross-hatching, and the like. The entire circumference or only portions of the circumference can be shaped.

Log home 10 can be a modular-type construction, with each section 15 generally being added to and removed from the log home 10 as an intact section 15. See for example, FIG. 3 which shows a wall from home 10 that is made from two sections 15*a* and 15*b*. Referring again to FIG. 2, it will be understood that if home 10 were disassembled into its multiple sections, every section 15 will not include horizontal logs 20 positioned between vertical posts 30. Rather, each individual section 15 will have horizontal logs 20, and, on average, each section 15 will have one vertical log 30; in another embodiment, every second section 15 will have two vertical logs 30, one at each end. In yet another embodiment, a section may not include any vertical logs 30. For example, such as shown in FIG. 3, if section 15*a* includes vertical posts 30*a* and 30*b*, adjacent section 15*b* has one vertical post 30*c*; alternately, section 15*b* may have no vertical posts because vertical post 30*c* is included in section 15*c* (seen in FIG. 2). Nevertheless, no matter how constructed, a vertical post 30 will generally be positioned between, and connecting, two adjacent sections 15, such as sections 15*a* and 15*b*.

As stated above, each section 15 includes horizontal logs 20 positioned between vertical posts 30. Vertical posts 30 bear the weight of the roof of the home 10 and provide the physical strength to the structure. Horizontal logs 20 extend between vertical posts 30; these horizontal logs 20 can be referred to as "filler logs", as they fill in the area between vertical posts 30. Horizontal logs 20 provide the majority of the solid structure of the walls of log home 10, yet bear essentially none of the weight of the roof. A cap log 40, shown in FIG. 3, extends across the tops of multiple adjacent sections 15; typically cap log 40 extends the entire length of the wall. Cap log 40 functions as a header beam, and distributes the weight of the roof over the vertical posts 30. A cap log 40 will also distribute the weight of subsequent floors or levels of the house.

The length of vertical posts 30 will depend on the desired wall height of the home 10. Generally, the length of vertical posts is about 7 to 10 feet, depending on the design of the home. Generally, the horizontal logs 20 in each section 15 are about 15 feet long (about 3 meters), although the exact length of logs 20 will depend on the overall length of section 15 and on the number and width of vertical posts 30.

As stated above, generally multiple sections 15, each which has horizontal logs 20, are used to form a wall of the log home 10. See for example, FIG. 3. In conventional log home construction, each side or wall of a typical log home is made with logs that extend the entire length of the wall; that is, one continuous tree is used the length of the home. Depending on the length of the home, it can be very difficult to find enough quality trees. This leads to builders using lower quality trees. Many times, large amounts of the tree are wasted. When the log must extend the entire length of the house, most long trees are cut to length and the removed portion is wasted. Additionally, it is preferable that the log has the same diameter along its length; as the length increases, it can be very difficult to find such a log. Typically, either manufactured logs are used, or logs are trimmed around their circumference to have a constant diameter.

Referring now to FIGS. 3 through 5, the construction of a section 15 will be explained. Section 15*a* has vertical posts 30*a*, 30*b* between which extend horizontal logs 20; section 15*b* shares vertical post 30*b* with section 15*a*, and has horizontal logs 20 which extend between vertical posts 30*b*, 30*c*. Cap log 40 extends across both sections 15*a*, 15*b* and is secured to vertical posts 30*a*, 30*b*, 30*c*.

Horizontal logs 20 are secured to vertical post 30 by a spline 25 between horizontal logs 20 and vertical post 30. Referring in particular to FIG. 4, a partial top view of section 15*b* is shown. Horizontal logs 20, which generally extend the vertical height of vertical post 30, include a groove 28 in an end face or end surface 22 of log 20. Groove 28 preferably extends through each of horizontal logs 20. Vertical log 30 also has a groove 38, which can extend the same distance as groove 28, but preferably extends the height of vertical log 30. Spline 25 connects, stabilizes, and otherwise attaches horizontal logs 20 to vertical log 30. Each of grooves 28 and 38 are sized to accept and hold securely spline 25. Preferably, spline 25 is equally distributed between groove 28 and groove 38.

If two sections 15 are placed end to end, such as sections 15*a*, 15*b* in FIGS. 2 and 3, vertical post 30*b* will have two grooves 38 positioned essentially 180 degrees opposite each other. If a bend or angle is desired in the wall, the vertical post 30 would be made with grooves 38 positioned at the desired angle. For example, for a right angle corner, such as shown in FIG. 2, the vertical post 30*c* has two grooves 38 positioned essentially at a right angle (90 degrees) from each other. It is feasible to have any angle between multiple grooves, depending on the design of the log home 10. Further in some designs, more than two walls may meet at a vertical post 30; this would provide more than two grooves in the post. FIG. 2 shows examples of three wall sections meeting at vertical post 30*b*, and four wall sections meeting at a vertical post 30*f*.

Grooves 28, 38 should have a width similar to the thickness or width of spline 25; in some embodiments, grooves 28, 38 may be a little wider. An example of a usable groove thickness is one inch. The depth of grooves 28, 38 should be sufficient to securely hold spline 25, yet not too deep to decrease the strength of the log, particularly vertical post 30. The sum of the depths of the two grooves 28, 38 should be essentially equal to the depth of spline 25, but in some embodiments it may be desired to have spline 25 a little shorter. An example of a usable groove depth is three inches.

Spline 25 can be metal, plastic, wood, or any other material. In some embodiments it is preferred that spline 25 is wood; a wood spline will expand and contract with the weather generally the same as the logs. A wood spline 25 can be made from a single piece of wood, or can be a strip of plywood, particle board, and the like.

Nails, screws, glue, or other fastening techniques can be used to secure spline 25 within grooves 28, 38 and secure horizontal logs 20 to vertical post 30. In some embodiments, glue and screws can be combined to create a secure fit.

Because the horizontal logs 20 are generally essentially circular in shape, various techniques can be used to improve the seating of horizontal logs 20 among themselves. FIG. 5 shows the bottom side of horizontal logs 20 notched to improve their seating on the lower log. Insulation or caulk can be placed within the notches 24 to seal the wall against drafts, rain, snow, and insects and other creatures. Alternately or additionally, the top edges and/or bottom edges of horizontal logs 20 (i.e., the edges which abut adjacent horizontal logs) can be shaped, e.g., flattened, to better seat against the adjacent log. Log screws, metal rods, lag screws, or reinforcing items or material can be placed through multiple horizontal logs 20 to strengthen the wall. Any reinforcing may extend the entire height of the wall, or multiple shorted segments, e.g., passing through two to three logs, can be spaced throughout the wall.

Another aspect of the present invention is that by using vertical posts 30 at the external corners of the log home, damage to the horizontal logs 20 is minimized. As seen in FIG. 2, each corner of home 10 has a vertical post 30. No end face or end surface 22 of horizontal logs 20 is exposed; rather, the ends abut vertical post 30, covering the faces 22. In FIG. 2, first end face 22*a* abuts vertical post 30*a* at the corner. Where two sections meet, such as at vertical post 30*b*, second end face 22*b* and third end face 22*c* are hidden. At the opposite corner at vertical post 30*c*, fourth end face 22*d* is hidden.

Hiding the end faces 22 of horizontal logs 20 minimizes the moisture that may seep into the logs 20 from the exterior of the home. Further, hiding the faces 22 minimizes the opportunity for insects and other creatures to burrow into the ends. The end faces 22 of horizontal logs 20 can be cut square to the vertical post 30; that is, the end face may be cut vertically planar, which can also be referred to as parallel to a vertical post. In other embodiments, the end faces 22 can be provided with a curved surface, or other topography, that shadows the exterior surface of vertical log 20. The ends of adjacent it cap logs 40 can be shaped to squarely abut, such as with 45 degree angles. In some embodiments, the ends of cap logs 40 can be left exposed, depending on the design of the home.

This design aspect of having the ends of the horizontal logs 20 can be further followed at the windows and doors. See for example, FIG. 3. Each window and door opening is framed, typically with lumber, to provide vertical boards that define the opening. The horizontal logs 20 abut this framing, hiding the end faces of the logs.

Another aspect of the present invention is that the logs used, both as horizontal logs 20 and vertical posts 30, and also as cap log 40, are not "green" logs, which have been recently felled. Rather, the present invention uses trees that have been either previously cut or have died. These older or dead logs are already dried, having lost the majority of their moisture content, prior to being used as building material.

Conventional log home constructions typically uses green trees, in order to find a log with sufficient length with the same diameter from top to bottom. The logs have a fairly high moisture content when they are incorporated into a log home. As the log dries, it shrinks, causing the construction to settle.

It is not practical for old or dead logs to be used in conventional constructions, because it is very rare to find an old or dead log that has sufficient length with an acceptable diameter. Even if logs of sufficient length can be found, many of the old and dead logs are broken, scarred, dented, or otherwise damaged, and cannot be used as they are. This greatly limits the availability of usable old and dead logs that have sufficient length. However, many of these logs do have discrete regions of limited length that are acceptable for use. The construction of the present invention is able to use these acceptable regions of old and dead logs because of the shortened sectional construction, as described above. The logs used by the present construction, approximately 15 feet (about 3 meters) long, can be salvaged from the long damaged logs.

Damaged logs are significantly less expensive than undamaged logs, in particular, significantly less expensive than long undamaged logs. By salvaging material from logs that might otherwise not be usable, the present invention decreases the cost of the log material, thus decreasing the cost paid by the homeowner.

Additionally, as mentioned above, building a home from dried logs rather than green logs practically eliminates shrinkage of the wood and thus settling of the walls. This greatly reduces the amount of maintenance and upkeep needed on the interior of the home; for example, less cracks occur in plaster and drywall, and fewer doors and windows need trimming or tuning.

This lack of settling allows the log construction of the present invention to be combined with various other construction materials, such as stone and cement. For example, a stone and mortar chimney can be included in one of the walls without fear sustaining serious cracking and crumbling of the chimney. The fear is eliminated because the settling of the log wall is minimal. As another example, a log wall can be combined with a brick, field stone, or other similar wall, without fear of serious cracking and possibly even separation. Various other advantages of minimal, or lack of, shrinking can be realized.

To build a log home, such as home 10 in FIG. 1, it is not necessary that the home actually be constructed on the site. Rather, with the construction technique of the present invention, the various sections 15 of home 10 can be constructed close to a log supply, and then transported to the home site.

Once the home has been designed, including the placement of the doors and windows, the lengths of the various sections 15 are calculated. Preferably, the length of each section is similar, although varying the distance between vertical posts 30 can be used to create various desirable patterns or designs. The placement of, and width and height of the windows and doors is included in the material calculation. Unlike conventional log constructions, which cut windows and doors out from a solid wall, the present construction technique builds the windows and doors into the wall, thus minimizing or eliminating wasted material.

The sections 15 are constructed by first obtaining logs which will provide sufficient number of logs of the desired length. The logs used are older logs that had been felled, for example, such as two years, before. Alternately or additionally, standing dead trees can be felled and used. Material is salvaged from damaged logs as possible.

Once collected, the logs are cut to the desired length for each section, taking into account the windows and doors; these will be horizontal logs 20. Notches 24, such as shown in FIG. 5, can be cut into one side of the logs; some designs may use notches or other features cut in two or more areas of the log. The logs are stacked or otherwise aligned to form a generally planar structure with the desired height. Any reinforcement, such as metal rods or screws, can be inserted as the logs are stacked or into the final wall. Once aligned, a groove 28 is formed in the end faces of the logs.

Any openings left for doors and windows can be framed in, for example, with lumber. Any number of windows or doors, for example two windows, or one window and one door, etc., can be in a single section 15.

Logs to use as vertical posts 30 are selected; it may be desired to select the larger, more sturdy logs with a larger diameter, to use as vertical posts 30. These logs are cut to the desired length, and grooves 38 are formed in the exterior of the log. Depending on the positioning of the post 30 in the home design, the grooves may be oppositely positioned (i.e., 180 degrees apart), or may be at a right angle (i.e., 90 degrees apart).

A spline 25, sized and shaped to fit within grooves 28, 38 is formed from any desired material.

At this point, the various structures for constructing a log building, such as log home 10, are completed and are ready to be assembled. It may be desired to attach vertical posts 30 to the walls formed by horizontal logs 20 prior to moving the structures to the final home site. To secure the horizontal log structure to a vertical post, spline 25 is inserted in either groove 28 of logs 20 or in groove 38 of vertical post 30; preferably, approximately half of spline 25 is retained in the groove. Any fastening mechanism, such as glue, screws, or both, may be used to secure spline 25 in the groove. The spline 25 is then inserted into the other groove, either groove 28 of logs 20 or groove 38 of post 30, and secured. This assembly with the spline 25 between horizontal logs 20 and vertical post 30 provides a secure construction.

It may be desired to also attach a vertical post 30 on the end of horizontal logs 20 opposite the already-attached vertical post 30; this would be accomplished by the same technique.

The resulting section, with horizontal logs 20 extending between two vertical posts 30 (such as section 15*a* with vertical posts 30*a,* 30*b* of FIG. 3) is ready to be transported to the home site, for example, on a flat bed truck or by train It is noted that not all the sections will have two vertical posts 30; rather, in one embodiment, half the sections will have two posts and the other half will have no posts. In another embodiment, most sections will have one post. Alternately, the vertical posts 30, sections of horizontal logs 20, and spline 25 can all be shipped independently, with none secured together.

The actual procedure for assembling and transporting the materials will generally differ with each different home design. However, the overall concept is to assemble the various sections, which have been previously made, to create the home. After a length of wall has been assembled and raised, a cap log 40, which extends across at least two sections and preferably the length of the entire wall, is placed and secured to the top of the vertical posts. This cap log 40 divides the load of the roof among the various vertical posts 30, and reduces swaying and buckling along the length of the wall.

The above specification, examples and data provide a complete description of the manufacture and use of the composition of the invention. Since many embodiments of the invention can be made without departing from the spirit and scope of the invention, the invention resides in the claims hereinafter appended.

What is claimed is:

1. A log construction comprising at least one exterior wall comprising:

(a) a first plurality of horizontal logs extending from and secured to a first vertical post and to a second vertical post;

(i) the first plurality of horizontal logs having a first end face and a second end face, the first end face having a first log groove therein and the second end face having a second log groove therein;

(ii) the first vertical post having a first post groove therein;

(iii) the second vertical post having a second post groove therein;

(iv) a first spline positioned in each of the first log groove and the first post groove, so as to connect the first plurality of horizontal logs to the first vertical post; and (v) a second spline positioned in each of the second log groove and the second post groove, so as to connect the first plurality of horizontal logs to the second vertical post;

(b) a second plurality of horizontal logs extending from and secured to the second vertical post and to a third vertical post;

(i) the second plurality of horizontal logs having a third end face and a fourth end face, the third end face having a third log groove therein and the fourth end face having a fourth log groove therein;

(ii) the second vertical post having a third post groove therein;

(iii) the third vertical post having a fourth post groove therein;

(iv) a third spline positioned in each of the third log groove and the third post groove, so as to connect the second plurality of horizontal logs to the second vertical post;

(v) a fourth spline positioned in each of the fourth log groove and the fourth post groove, so as to connect the second plurality of horizontal logs to the third vertical post;

(vi) the first plurality of horizontal logs being coplanar with the second plurality of horizontal logs; and (c) a cap log positioned above and extending across the first plurality of horizontal logs and the second plurality of horizontal logs, from the first vertical post to the third vertical post.

2. The log construction according to claim 1, wherein the at least one exterior wall further comprises a third plurality of horizontal logs extending from the third vertical post to a fourth vertical post.

3. The log construction according to claim 1, wherein at least a portion of the first plurality of horizontal logs and at least a portion of the second plurality of horizontal logs are dried logs.

4. The log construction according to claim 1, further comprising a window positioned within one of the first plurality of horizontal logs and the second plurality of horizontal logs.

5. The log construction according to claim 1, wherein the first plurality of horizontal logs is secured to the first vertical post and to the second vertical post by screws, and the second plurality of horizontal logs is secured to the second vertical post and to the third vertical post by screws.

6. The log construction according to claim 1, wherein:

(a) the first vertical post is positioned approximately 15 feet from the second vertical post.

7. A log construction having an exterior wall, the exterior wall comprising:

(a) a plurality of vertical corner posts, one of the plurality of vertical corner posts positioned in each corner of the log construction;

(b) a second plurality of vertical posts, at least one of the second plurality of vertical posts positioned within the exterior wall between each corner;

(c) multiple horizontal logs, each of the multiple horizontal logs extending between and secured to at least one adjacent vertical post, wherein the adjacent vertical post is from the plurality of vertical corner posts, the second plurality of vertical posts, or the combination thereof;

(d) a plurality of splines positioned between and secured to one of the plurality of vertical corner posts or one of the second plurality of vertical posts and to multiple horizontal logs; and (e) a cap log extending from a first post of the plurality of vertical corner posts to a second post of the plurality of vertical-corner posts.

8. The log construction according to claim 7, wherein each of the multiple horizontal logs has a first end face and a second end face, each of the first end face and the second end face abutting either one of the plurality of vertical corner posts or one of the second plurality of vertical posts.

9. The log construction according to claim 7, wherein at least one of the first end face and the second end face is planar and parallel to a post it abuts.

10. The log construction according to claim 7, the exterior wall further comprising a window and a door.

11. The log construction according to claim 10, wherein each of the multiple horizontal logs has a first end face and a second end face, each of the first end face and the second end face abutting either one of the plurality of vertical corner posts, one of the second plurality of vertical posts, a window frame, or a door frame.

12. The log construction according to claim 7, wherein at least a portion of the plurality of horizontal logs are dried logs.

13. The log construction according to claim 7, wherein the multiple horizontal logs are secured to the adjacent vertical post by screws.

14. The log construction according to claim 7, wherein at least one of the second plurality of vertical posts positioned within the exterior wall between each corner is positioned about 15 feet from a vertical corner post.

15. A method of making a lo construction the method comprising:

(a) building a first wall section by;
  (i) providing a first post;
  (ii) positioning a second post parallel to the first post;
  (iii) connecting the first post and second post with a first plurality of logs extending perpendicular to the first post and to the second post, wherein the first plurality of logs is secured together and to the first post and to the second post;

(b) building a second wall section by:
  (i) providing a third post;
  (ii) positioning a second plurality of logs extending perpendicular to the third post, wherein the second plurality of logs is secured together and to the third posts;

(c) positioning the second wall section adjacent to and planar to the first wall section and securing the second wall section to the first wall section at the second post; and (d) placing a cap log on the first wall section and the second wall section, the cap log extending from the first post to the third post.

16. The method according to claim 15, wherein tie step of building a first wall section comprises:

(a) positioning a second post approximately 15 feet from the first post.

17. The method according to claim 15, wherein the steps of building a first wall section and building a second wall section are done at a first site, and the steps of positioning the second wall section adjacent to and planar to the first wall section and placing a cap log on the first wall section and the second wall section are done at a home site.

18. The method according to claim 15, further comprising:

(a) connecting the first plurality of horizontal logs to the first post by:
  (i) providing a first log groove in a first face of the first plurality of horizontal logs;
  (ii) providing a first post groove in the first post; and
  (iii) positioning a first spline in each of the first log groove and the first post groove;

(b) connecting the first plurality of horizontal logs to the second post by:
  (i) providing a second log groove in a second face of the first plurality of horizontal logs;
  (ii) providing a second post groove in the second post; and
  (iii) positioning a second spline in each of the second log groove and the second post groove;

(c) connecting the second plurality of horizontal logs to the second post by:
  (i) providing a third log groove in a first face of the second plurality of horizontal logs;
  (ii) providing a third post groove in the second post; and
  (iii) positioning a third spline in each of the third log groove and the third post groove; and (d) connecting the second plurality of horizontal logs to the third post by:
  (i) providing a fourth log groove in a second face of the second plurality of horizontal logs;
  (ii) providing a fourth post groove in the third post; and
  (iii) positioning a fourth spline in each of the fourth log groove and the fourth post groove.

19. The method according to claim 18, further comprising:

(a) securing the first splice in the first log groove and the first post groove with a fastening mechanism.

20. The method according to claim 19, wherein the fastening mechanism is a screw.

21. The method according to claim 15, wherein at least a portion of the first plurality of horizontal logs and at least a portion of the second plurality of horizontal logs are dried logs.

22. The method according to claim 15, wherein the step of positioning a second post parallel to the first post comprises:

(a) positioning the second post about 15 feet from the first post.

* * * * *

UNITED STATES PATENT AND TRADEMARK OFFICE

CERTIFICATE OF CORRECTION

PATENT NO. : 6,363,672 B1
DATED : April 2, 2002
INVENTOR(S) : Baker

It is certified that error appears in the above-identified patent and that said Letters Patent is hereby corrected as shown below:

Column 9,
Line 24, “lo construction the” should read -- log construction, the --
Line 48, “tie” should read -- the --

Signed and Sealed this

Twelfth Day of November, 2002

*Attest:*

*Attesting Officer*

JAMES E. ROGAN
*Director of the United States Patent and Trademark Office*